US006973802B1

(12) United States Patent
Seo et al.

(10) Patent No.: US 6,973,802 B1
(45) Date of Patent: Dec. 13, 2005

(54) ICE SUPPLY DEVICE AND REFRIGERATOR HAVING THE SAME

(75) Inventors: Eung Ryeol Seo, Gwangju (KR); Tae Wan Kang, Gwangju (KR); Sang Gyu Jung, Gwangju (KR); Yo Hyun Song, Gwangju (KR); Myung Wouk Kim, Seo-gu (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/879,516

(22) Filed: Jun. 30, 2004

(30) Foreign Application Priority Data

May 31, 2004 (KR) ..... 10-2004-0039317

(51) Int. Cl.[7] ..... F25C 5/04
(52) U.S. Cl. ..... 62/320; 62/344; 241/DIG. 17
(58) Field of Search ..... 62/320, 344; 222/240–242, 222/412, 413; 241/DIG. 17

(56) References Cited

U.S. PATENT DOCUMENTS 3,602,406 A * 8/1971 Jacobus et al. ..... 222/413
3,640,088 A * 2/1972 Jacobus et al. ..... 62/320
4,176,527 A * 12/1979 Linstromberg et al. ..... 62/320
4,512,502 A * 4/1985 Landers ..... 222/413
4,627,556 A 12/1986 Brooks
5,273,219 A * 12/1993 Beach et al. ..... 241/65
5,947,342 A * 9/1999 Song ..... 222/413
6,010,037 A 1/2000 Thompson
6,880,355 B2 * 4/2005 Jung ..... 62/320

FOREIGN PATENT DOCUMENTS

KR 20010105953 A 11/2001

* cited by examiner

*Primary Examiner*—William E. Tapolcai
(74) *Attorney, Agent, or Firm*—Staas & Halsey LLP

(57) ABSTRACT

An ice supply device and a refrigerator having the same. The ice supply device includes an ice tray provided with an outlet for discharging ice cubes therethrough at one side thereof, a conveying device installed in the ice tray and rotated to convey the ice cubes toward the outlet, an ice crushing device, installed at the outlet, for crushing the ice cubes conveyed toward the outlet, a pressure device having a hollowed cylindrical structure for pushing the ice cubes to the ice crushing device by applying pressure to the ice cubes, and a catching member, by which the ice cubes outwardly protruded from an inlet of the pressure device are caught. The ice cubes exceeding designated dimensions, which do not pass through the pressure device and are outwardly protruded from the pressure device, are caught by the catching member and are sliced away from main portions of the ice cubes, thereby reducing the sizes of the ice cubes and allowing the ice cubes to be smoothly supplied.

8 Claims, 3 Drawing Sheets

ICE SUPPLY DEVICE AND REFRIGERATOR HAVING THE SAME

CROSS-REFERENCE TO RELATED APPLICATION

This application claims the benefit of Korean Patent Application No. 2004-39317, filed May 31, 2004, in the Korean Intellectual Property Office, the disclosure of which is incorporated herein by reference.

BACKGROUND OF THE INVENTION

1. Field of the Invention

The present invention relates to an ice supply device and a refrigerator having the same, and more particularly to an ice supply device for smoothly supplying ice cubes and a refrigerator having the same.

2. Description of the Related Art

Generally, a refrigerator is an apparatus comprising components for constituting a refrigerating cycle, and serves to freeze or refrigerate stored goods therein by generating cool air.

There is disclosed a recent refrigerator comprising an ice-making device for making ice cubes and an ice supply device for supplying ice cubes made by the ice-making device to the outside without opening a door of the refrigerator.

The ice supply device includes an ice tray, for containing the ice cubes made by the ice-making device, provided with an outlet for discharging the ice cubes therethrough, a conveying member placed in the ice tray for conveying the ice cubes to the outlet, a crushing device placed at the outlet for crushing the ice cubes conveyed by the conveying member, and a pressure device for pushing the ice cubes into the crushing device by applying pressure to the ice cubes. The pressure device includes a spiral-shaped cylindrical vane portion having a hollow therein for applying pressure to the ice cubes, and apples pressure to the ice cubes placed therein by means of the rotation of the vane portion and then pushes the ice cubes into the crushing device.

However, in case that the ice cubes made by the ice-making device of the above refrigerator is stored in the ice tray for a long period of time, the ice cubes are conglomerated into a large lump. When the ice lump is guided to the pressure device, the ice lump cannot completely pass through the pressure device and clogs an inlet of the pressure device, thereby causing delay of the ice cube supply.

SUMMARY OF THE INVENTION

Therefore, an aspect of the invention is to provide an ice supply device for smoothly supplying ice cubes and a refrigerator having the same.

In accordance with one aspect, the present invention provides an ice supply device comprising: an ice tray provided with an outlet for discharging ice cubes therethrough at one side thereof; a conveying device installed in the ice tray and rotated to convey the ice cubes toward the outlet; an ice crushing device, installed at the outlet, for crushing the ice cubes conveyed toward the outlet; a pressure device having a hollowed cylindrical structure for pushing the ice cubes to the ice crushing device by applying pressure to the ice cubes; and a catching member, by which the ice cubes outwardly protruded from an inlet of the pressure device are caught.

The catching member may include a fixed portion fixedly installed on the ice tray, and a catching portion, integrally extended from the fixed portion in a radially inner direction of the pressure device.

The pressure device may include a guide portion having a hollowed cylindrical structure, and a vane portion disposed on the inner circumference of the guide portion in a spiral shape and rotated to push the ice cubes into the crushing device by applying pressure to the ice cubes.

The conveying device may include a spiral shaft having a spiral shape, and a driving motor placed at one side of the spiral shaft for rotating the spiral shaft.

In accordance with another aspect, the present invention provides a refrigerator comprising: a main body defining an outer appearance and including a freezing chamber for freezing stored goods therein; a door installed at one side of the main body for opening and closing the freezing chamber; an ice-making device placed in the freezing chamber for making ice cubes; and an ice supply device, for supplying the ice cubes made by the ice-making device to the outside without opening the door, said ice supply device including; an ice tray provided with an outlet for discharging ice cubes therethrough at one side thereof; a spiral member installed in the ice tray and rotated to convey the ice cubes toward the outlet; an ice crushing device, installed at the outlet, for crushing the ice cubes conveyed toward the outlet; a pressure device having a hollowed cylindrical structure for pushing the ice cubes to the ice crushing device by applying pressure to the ice cubes; and a catching member, by which the ice cubes outwardly protruded from an inlet of the pressure device, into which the ice cubes are introduced, are caught.

The catching member may include a fixed portion fixedly installed on the ice tray, and a catching portion, integrally extended from the fixed portion in a radially inner direction of the pressure device.

The pressure device may include a guide portion having a hollowed cylindrical structure, and a vane portion disposed on the inner circumference of the guide portion in a spiral shape and rotated to push the ice cubes into the crushing device by applying pressure to the ice cubes.

The spiral member may include a spiral shaft having a spiral shape, and a driving motor placed at one side of the spiral shaft for rotating the spiral shaft.

BRIEF DESCRIPTION OF THE DRAWINGS

These and/or other aspects and advantages of the invention will become apparent and more readily appreciated from the following description of the embodiments, taken in conjunction with the accompanying drawings in which.

DETAILED DESCRIPTION OF THE PREFERRED EMBODIMENTS

Figure 1:
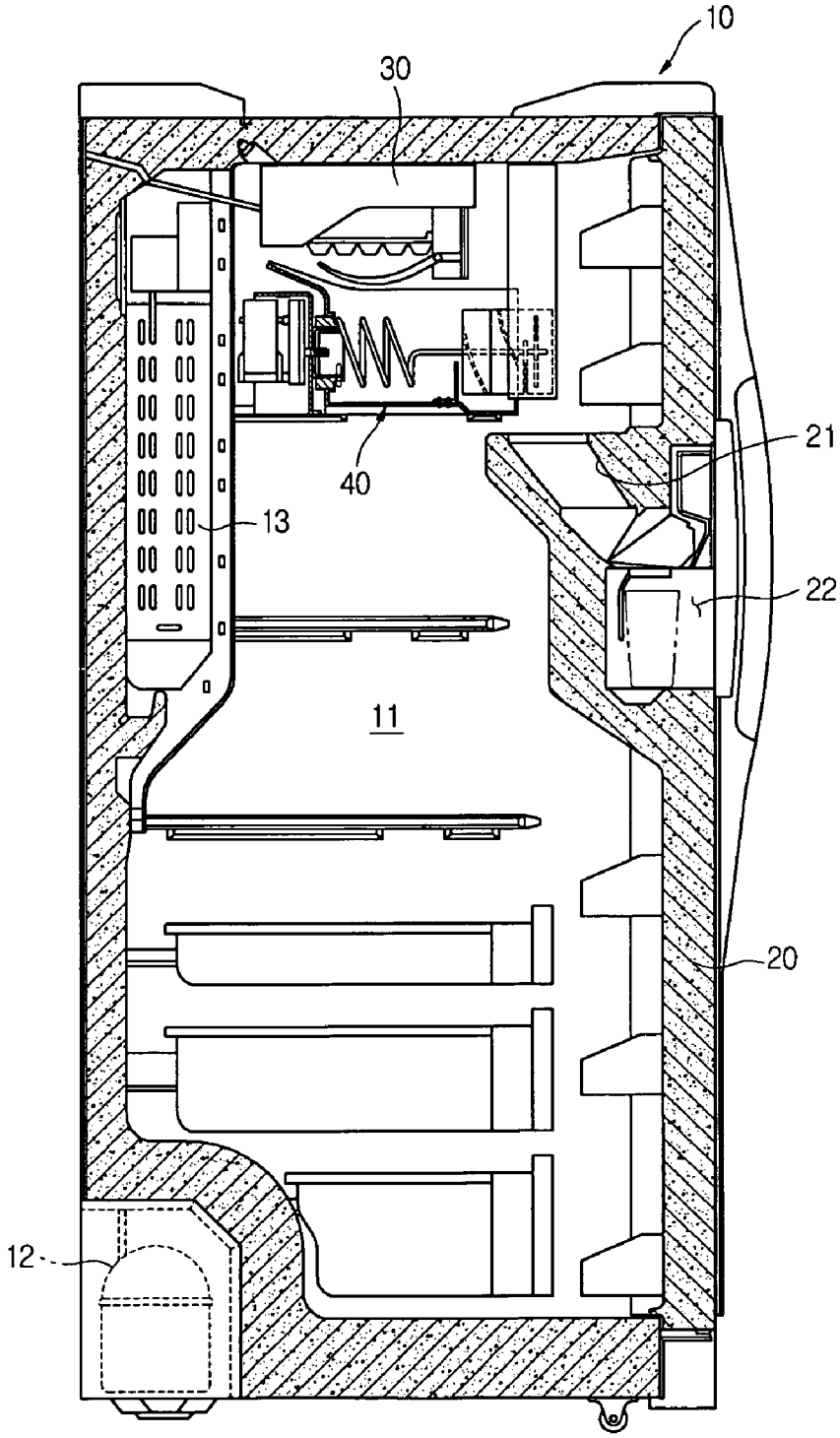
FIG. 1 is a longitudinal-sectional view of a refrigerator having an ice supply device in accordance with the present invention.

Reference will now be made in detail to the embodiment of the present invention, an example of which is illustrated in the accompanying drawings, wherein like reference numerals refer to the like elements throughout. The embodiment is described below to explain the present invention by referring to the figures.

As shown in FIG. 1, a refrigerator in accordance with the present invention comprises a main body 10 having an opening formed through the front surface thereof for containing foods therein and defining a freezing chamber 11, and a door 20 hinged to one side of the main body 10 and rotated to open and close the freezing chamber 11. Components constituting a refrigerating cycle, such as a compressor 12, a condenser (not shown), an evaporator 13, an expansion valve (not shown), are installed in the main body 10 for generating cool air in the main body 10, thereby cooling the inside of the freezing chamber 11. In this embodiment of the present invention, the compressor 12 is disposed in a lower portion of the main body 10, and the evaporator 13 is disposed in a rear part of an upper portion of the freezing chamber 11.

An ice-making device 30 for making ice cubes is installed in the upper portion of the freezing chamber 11. An ice supply device 40 for storing the ice cubes made by the ice-making device 30 and, if necessary, discharging the stored ice cubes to the outside is disposed below the ice-making device 30. A discharge guide panel 21, communicating with the inside of the freezing chamber 11, for guiding the discharge of the ice cubes is installed in the door 20 so that the ice cubes made by the ice-making device 30 may be taken out without opening the door 20 by a user, and an ice receiving portion 22 for easily receiving the ice cubes discharged through the discharge guide panel 21 is formed in the front surface of the door 20.

Figure 2:
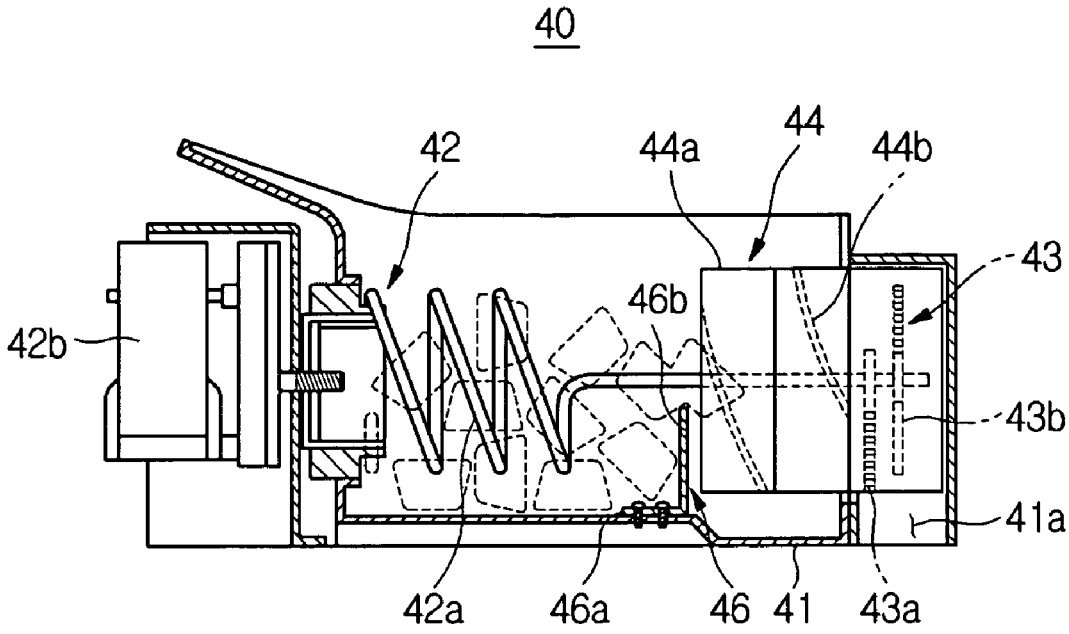
FIG. 2 is a cross-sectional view of the ice supply device in accordance with the present invention.
Figure 3:
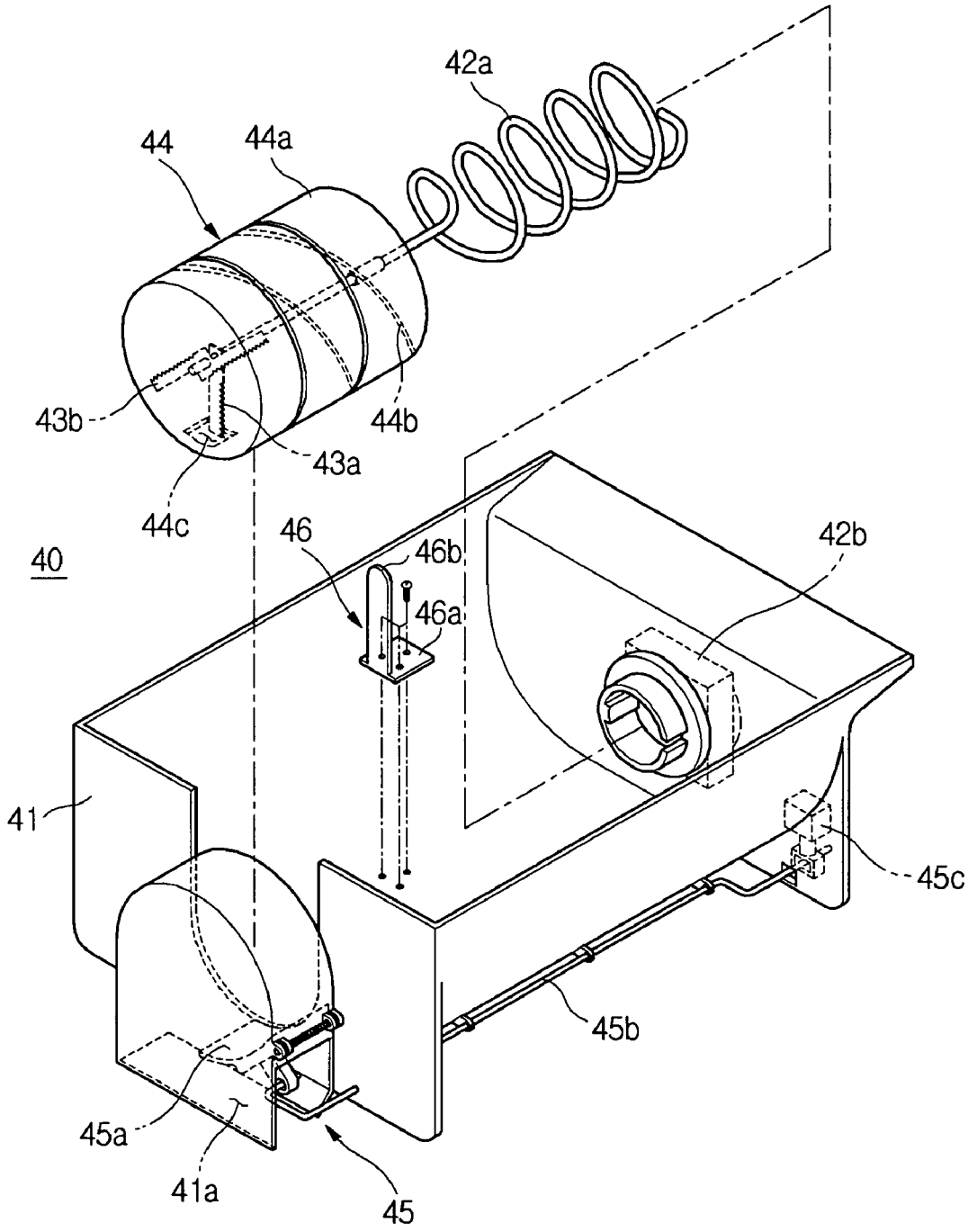
FIG. 3 is a perspective view of the ice supply device in accordance with the present invention.

As shown in FIGS. 2 and 3, the ice supply device 40 includes an ice tray 41, for containing the ice cubes made by and dropped from the ice-making device 30, provided with an outlet 41*a* formed through a front surface thereof for discharging the ice cubes, a conveying device 42 for conveying the ice cubes from the ice tray 41 to the outlet 41*a*, a crushing device 43 placed at the outlet 41*a* for selectively crushing the ice cubes discharged through the outlet 41*a*, and a pressure device 44 placed in parallel with the crushing device 43 for pushing the ice cubes into the crushing device 43 by applying pressure to the ice cubes.

The ice tray 41 is provided with an opened upper surface so that the ice cubes dropped from the ice-making device 30 are received by the ice tray 41 through the opened upper surface thereof, and lower and side surfaces, each surface having a semicircular shape so that the ice cubes contained in the ice tray 41 can be stably conveyed by the conveying device 42.

The conveying device 42 includes a spiral shaft 42*a* having a spiral shape for conveying the ice cubes, and a driving motor 42*b* placed at a rear surface of the ice tray 41 opposite to the outlet 41*a* and connected to one end of the spiral shaft 42*a* for rotating the spiral shaft 42*a*. The conveying device 42 serves to convey the ice cubes toward the outlet 41*a* by the rotation of the spiral shaft 42*a* based on the rotation of the driving motor 42*b*.

The pressure device 44 includes a guide portion 44*a* having a hollowed cylindrical structure for guiding the ice cubes, and a vane portion 44*b* disposed on the inner circumference of the guide portion 44*a* in a spiral shape and rotated to push the ice cubes into the crushing device 43 by applying pressure to the ice cubes. Here, the vane portion 44*b* is installed on the spiral shaft 42*a*, and is rotated by the rotation of the spiral shaft 42*a* to push the ice cubes into the crushing device 43 by applying pressure to the ice cubes. The pressure device 44 further includes a discharge hole 44*c* formed through a lower portion of one side thereof so that the crushed ice cubes are discharged to the outlet 41*a* through the discharge hole 44*c*.

The crushing device 43 includes a stationary cutter 43*a* fixed to the outlet 41*a* of the ice tray 41, and a rotary cutter 43*b* rotated together with the rotation of the spiral shaft 42*a*. When the rotary cutter 43*b* is rotated, the ice cubes, introduced into the crushing device 43 by the pressure device 44, are caught between the stationary cutter 43*a* and the rotary cutter 43*b*, are crushed, and are then discharged toward the outlet 41*a* through the discharge hole 44*c*.

In order to selectively discharge the non-crushed ice cubes and the finely-crushed ice cubes, a discharge hole switching device 45 for controlling the opening degree of the discharge hole 44*c* of the crushing device 43 is prepared.

The discharge hole switching device 45 includes a switching member 45*a* rotatably connected to the discharge hole 44*c* of the crushing device 43, a connection rod 45*b* rotatably installed on the side surface of the ice tray 41 so as to operate the switching member 45*a*, and a solenoid driving unit 45*c* installed at one side of the rear portion of the ice tray 41 so as to rotate the connection rod 45*b* to a designated degree. The rotation of the connection rod 45*b* by the solenoid driving unit 45*c* rotates the switching member 45*a*, thereby opening or closing the outlet 41*a*.

The ice supply device 40 in accordance with the present invention further includes a catching member 46, by which ice cubes outwardly protruded from the pressure device 40 are caught. The catching member 46 is disposed adjacent to the inlet of the guide portion 44*a*, into which the ice cubes are introduced, and contacts parts of the ice cubes caught by the guide portion 44*a*, which are outwardly protruded from the guide portion 44*a*.

Accordingly, in case that the ice cubes having a designated size do not completely pass through a space between the guide portion 44*a* and the vane portion 44*b* of the pressure device 40 and are partially protruded from the guide portion 44*a*, these ice cubes are rotated together with the rotation of the vane portion 44*b* so that the protruded portions of the ice cubes are caught by the catching member 46. Then, the protruded portions of the ice cubes are sliced away from main portions thereof by the force of the catching member 46, thereby allowing the ice cubes to have a reduced size and then to smoothly pass through the gap between the guide portion 44*a* and the vane portion 44*b*.

In the preferred embodiment of the present invention, the catching member 46 includes a fixed portion 46*a* fixedly installed on the ice tray 41, and a catching portion 46*b*, integrally extended from the fixed portion 46*a* in a radially inner direction of the guide portion 44*a*, for catching portions of the ice cubes, which do not pass through the pressure device 44 and are outwardly protruded from the guide portion 44*a*.

As apparent from the above description, the present invention provides an ice supply device, in which, in case that ice cubes exceeding designated dimensions do not pass through a pressure device and are outwardly protruded from the pressure device, the ice cubes are rotated together with the rotation of a vane portion of the pressure device so that the protruded portions of the ice cubes are caught by a catching member of the pressure device and are sliced away from the main portions of the ice cubes, and a refrigerator having the ice supply device, thereby reducing the size of the ice cubes and allowing the ice cubes to be smoothly supplied.

Although an embodiment of the invention has been shown and described, it would be appreciated by those skilled in the art that changes may be made in this embodiment without departing from the principles and spirit of the invention, the scope of which is defined in the claims and their equivalents.

What is claimed is:

1. An ice supply device comprising:

an ice tray provided with an outlet for discharging ice cubes therethrough at one side thereof;

a conveying device installed in the ice tray and rotated to convey the ice cubes toward the outlet;

an ice crushing device, installed at the outlet, for crushing the ice cubes conveyed toward the outlet;

a pressure device having a hollowed cylindrical structure for pushing the ice cubes to the ice crushing device by applying pressure to the ice cubes; and a catching member, by which the ice cubes outwardly protruded from an inlet of the pressure device are caught.

2. The ice supply device according to claim 1, wherein the catching member includes a fixed portion fixedly installed on the ice tray, and a catching portion, integrally extended from the fixed portion in a radially inner direction of the pressure device.

3. The ice supply device according to claim 1, wherein the pressure device includes a guide portion having a hollowed cylindrical structure, and a vane portion disposed on the inner circumference of the guide portion in a spiral shape and rotated to push the ice cubes into the crushing device by applying pressure to the ice cubes.

4. The ice supply device according to claim 1, wherein the conveying device includes a spiral shaft having a spiral shape, and a driving motor placed at one side of the spiral shaft for rotating the spiral shaft.

5. A refrigerator comprising:

a main body defining an outer appearance and including a freezing chamber for freezing stored goods therein;

a door installed at one side of the main body for opening and closing the freezing chamber;

an ice-making device placed in the freezing chamber for making ice cubes; and an ice supply device, for supplying the ice cubes made by the ice-making device to the outside without opening the door, said ice supply device including;

an ice tray provided with an outlet for discharging ice cubes therethrough at one side thereof;

a spiral member installed in the ice tray and rotated to convey the ice cubes toward the outlet;

an ice crushing device, installed at the outlet, for crushing the ice cubes conveyed toward the outlet;

a pressure device having a hollowed cylindrical structure for pushing the ice cubes to the ice crushing device by applying pressure to the ice cubes; and a catching member, by which the ice cubes outwardly protruded from an inlet of the pressure device, into which the ice cubes are introduced, are caught.

6. The refrigerator according to claim 5, wherein the catching member includes a fixed portion fixedly installed on the ice tray, and a catching portion, integrally extended from the fixed portion in a radially inner direction of the pressure device.

7. The refrigerator according to claim 5, wherein the pressure device includes a guide portion having a hollowed cylindrical structure, and a vane portion disposed on the inner circumference of the guide portion in a spiral shape and rotated to push the ice cubes into the crushing device by applying pressure to the ice cubes.

8. The refrigerator according to claim 5, wherein the spiral member includes a spiral shaft having a spiral shape, and a driving motor placed at one side of the spiral shaft for rotating the spiral shaft.

* * * * *